United States Patent [19]

Kobayashi et al.

[11] 4,431,400

[45] Feb. 14, 1984

[54] IGNITION SYSTEM FOR POST-MIXED BURNER

[75] Inventors: Hisashi Kobayashi, Tarrytown; Raymond H. Miller, Hopewell Junction; John E. Anderson, Katonah, all of N.Y.

[73] Assignee: Union Carbide Corporation, Danbury, Conn.

[21] Appl. No.: 289,885

[22] Filed: Aug. 4, 1981

[51] Int. Cl.[3] ..... F23Q 3/00

[52] U.S. Cl. ..... 431/6; 431/266

[58] Field of Search ..... 431/264, 265, 266, 254, 431/255, 6; 361/253, 261; 313/118, 130

[56] References Cited

U.S. PATENT DOCUMENTS

| | | | |
|---|---|---|---|
| 2,865,441 | 12/1958 | Coupe | 431/263 |
| 2,996,113 | 8/1961 | Williams | 431/266 |
| 3,167,109 | 1/1965 | Wobig | 158/73 |
| 3,439,995 | 4/1969 | Hattori et al. | 431/266 |
| 3,556,706 | 1/1971 | Campbell | 431/265 |
| 3,558,251 | 1/1971 | Bauger et al. | 431/266 |
| 3,614,280 | 10/1971 | Tamio | 431/25 |
| 4,023,351 | 5/1977 | Beyler et al. | 60/39.74 |

FOREIGN PATENT DOCUMENTS

| | | | |
|---|---|---|---|
| 421854 | 8/1974 | U.S.S.R. | 431/266 |

*Primary Examiner*—Samuel Scott
*Assistant Examiner*—Margaret A. Focarino
*Attorney, Agent, or Firm*—Stanley Ktorides

[57] ABSTRACT

An ignition system for post-mixed gas burner which achieves reliable ignition without requiring an expensive spark source protection device, or a means to promote fuel-oxidant mixing, or a large amount of electricity, or a separate pilot light.

15 Claims, 5 Drawing Figures

IGNITION SYSTEM FOR POST-MIXED BURNER

BACKGROUND OF THE INVENTION

This invention relates to a direct spark ignition system for post-mixed burners which reliably ignites the combustible mixture while avoiding high igniter wear as well as the need for complex igniter protection systems.

Burners are generally divided into two types, pre-mixed and post-mixed. A pre-mixed burner is one in which the fuel and the oxidant are mixed before they enter the burner nozzle and prior to being discharged into the combustion zone. A post-mixed burner is one in which the fuel and oxidant are kept separate until discharged into the combustion zone.

Ignition systems are customarily designed with reference primarily to two criteria: (1) reliable ignition of the fuel-oxidant mixture, and (2) protection of the ignition is achieved. It can be readily appreciated that the elements of an ignition system will be easily destroyed at the temperatures characteristic of a combustion zone.

A typical post-mixed burner ignition system normally comprises means to shield the ignition system from the high combustion zone temperatures since the ignition system must deliver the ignition flame to the fuel-oxidant mixture in the combustion zone. A commonly used means employs a separate pilot flame which is ignited in an area protected from the intense heat of the combustion zone and then passed to the combustion zone to ignite the main combustion components. The major disadvantage of such a system is the requirement of having a duplicate fuel and oxidant supply system attached to the main burner assembly.

Another typical post-mixed burner ignition system is one that retracts the ignition system immediately after the delivery of the ignition flame. Such means are mechanically complicated and require high initial capital costs as well as high operating and maintenance costs.

Still another typical post-mixed burner ignition system is one which employs means to create good fuel-oxidant mixing in the area of the spark. As mentioned previously, a post-mixed burner is one where fuel and oxidant are not mixed until they are discharged into the combustion zone. Such post-mixed burners promote good mixing of fuel and oxidant in the area of the spark in place of providing sparks to the area of good mixing, as with a retraction device. Disadvantages of this system include the need for a good-mixing promoter, such as a deflection device, atomizer, etc., which may be bulky or otherwise cumbersome, and the fact that spark electrode wear is markedly increased when burning occurs near it, as happens when good fuel-oxidant mixing occurs in its vicinity.

Where the ignition system is not a direct system, such as an intermittent or interrupted pilot flame, burning near the electrode may be tolerable, because many systems are not designed to be fired continuously. Thus, these systems are able to tolerate momentary high temperatures around the electrode caused by burning of the well-mixed fuel oxidant mixture in their proximity. A direct ignition system which is required to be fired continuously cannot tolerate such high temperatures near the electrode without incurring high wear or deterioration.

Still another typical post-mixed burner ignition system provides sparks to an area of good fuel-oxidant mixing without placing the spark generation system in that area by projecting only the spark into the area. This may be done by increasing the voltage used to produce the spark so that the spark loops outward from the generation system into the area of good mixing: alternatively, the spark may be made to loop outward by placing it in the path of a swiftly moving gas stream. As can be appreciated, methods such as these require a significant increase in energy usage.

An ignition system for a post-mixed burner which is capable of providing ignition reliability, while affording protection for the ignition system from the hot combustion zone conditions, while avoiding the need for additional parts to the burner assembly and high energy requirements to effect ignition would be highly desirable.

OBJECTS

It is therefore an object of this invention to provide an ignition system for post-mixed burners.

It is another object of this invention to provide an ignition system for a post-mixed burner which will reliably ignite the combustible mixture of fuel and oxidant discharged from the burner.

It is still another object of this invention to provide an ignition system for a post-mixed burner which will afford protection for the ignition system from the hot combustion zone conditions.

It is yet another object of this invention to provide an ignition system for a post-mixed burner which is relatively free of complex and costly parts and mechanisms.

It is another object of this invention to provide an ignition system for a post-mixed burner that is energy efficient.

SUMMARY OF THE INVENTION

The above and other objects which will become readily apparent to those skilled in the art are attained by the ignition system of this invention, one aspect of which comprises:

A post-mixed burner apparatus capable of igniting a combustible gas mixture of fuel and oxidant discharged from the burner comprising:

a first passage means for supplying fuel gas and a second passage means for supplying an oxidant gas, both of said passage means terminating at the discharge end of said apparatus, characterized by an ignition system consisting of:

(1) said first passage means being electrically conductive;

(2) said second passage means being electrically conductive and spaced from said first passage means such that the breakdown voltage between said first and second passage means is lowest at the discharge end of said apparatus; and (3) means for applying an electrical potential across said first and second passage means, whereby, when an electrical potential greater than said lowest breakdown voltage is applied across said first and second passage means, an electrical discharge occurs, in an essentially straight line, only across the space between said first and second passage means at the discharge end.

Another aspect of the ignition system of the invention comprises:

A process for igniting a combustible gaseous mixture comprising:

(A) causing a stream of fuel gas and a stream of oxidant gas to flow in the same direction through first and second passages which are electrically conductive and insulated from each other, each of which passages having a discharge end;

(B) maintaining said flowing streams separated from each other by said first passage;

(C) mixing said gas streams upon discharge from said passages;

(D) spacing said second passage from said first passage such that the breakdown voltage between said first and second passages is lowest at the discharge end of said first passage; and (E) applying an electrical potential greater than said lowest breakdown voltage across said first and second passages such that an electrical discharge occurs, in an essentially straight line, only across the space between said first and second passages at the discharge end of said first passage, which space contains essentially only one of the gases.

The term, breakdown voltage, is used to mean the voltage or difference in potential between two conductors required to cause an electric spark to discharge between the two conductors.

The term, directly igniting, is used to mean the igniting of a main burner without the need of a pilot burner or some other such auxiliary device.

DESCRIPTION OF THE INVENTION

Figure 1:
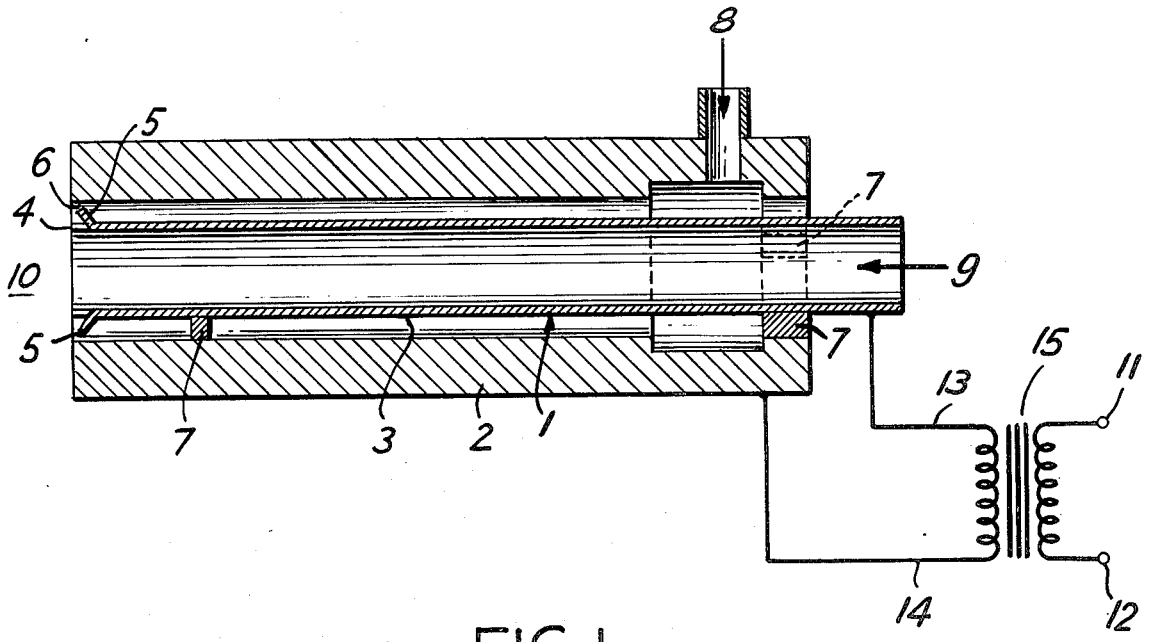
FIG. 1 is a lengthwise cross-sectional representation of one embodiment of the ignition system of this invention.

This invention comprises, in part, a passage through which is passed either fuel gas or oxidant gas. The passage divides the gas stream inside the passage from the other gas which is in a stream outside the passage. That is, if the gas stream inside the passage is oxidant gas, the stream outside the passage is fuel gas, and, if the stream inside the passage is fuel gas, that outside the passage is oxidant gas. When the stream inside the passage emerges from the discharge end, the two heretofore separated gas streams mix to form a combustible mixture.

Another element of this invention is a second passage spaced from the first passage such that the breakdown voltage between them is lowest at the discharge end.

A third part of this invention is a means to apply an electrical potential across the passages.

Both the passages are conductive to electricity; however, they are insulated from each other. Thus, when an electrical potential is applied across the passages, the electricity travels through the walls of both the passages but does not pass from one to the other. However, when the potential applied across the passages is greater than the breakdown voltage at the discharge end which, as previously mentioned, is the lowest breakdown voltage between the passages at any point along their length, the electricity discharges across the passages at the discharge end.

The arc, or spark, is thus created in an area or zone where there is substantially only either fuel gas or oxidant gas and where there is no significant mixing of the two gases. However, the fuel and oxidant gas mixture, or combustible mixture, in the combustion zone is ignited by the discharge of electricity between the two passages and thus the objects of this invention are achieved. The spark discharges essentially straight across the two conductors with no requirement for whirling or looping the spark and thus avoids the higher energy requirements of a system which requires such whirling or looping spark.

Reliable ignition is achieved at a relatively low level of energy consumption. As mentioned, one need apply a potential across the passages which only exceeds the lowest breakdown voltage between them at the discharge end. This results in discharge between these two conductors only at the discharge end. If one applied a greatly increased potential across the conductors, one might observe discharge between them at other points along their length if the increased potential exceeded the breakdown voltage at these points, or one might observe the looping of the spark outward into an area of good fuel-oxidant mixing. The reliable ignition one achieves at the relatively low power consumption required by this invention is one advantage of the process and apparatus of this invention.

As mentioned above, the spark occurs in an area not characterized by good fuel-oxidant mixing and thus there does not occur a great deal of combustion, right around the spark generation points. Thus, the wear and maintenance requirements of these portions of the burner are significantly reduced. This is particularly important in the continuous operating conditions characteristic of direct ignition systems.

The ignition system comprises essentially only the burner parts. The ignition system of this invention thus avoids the need for a separate spark plug, or pilot flame, or additional electrodes, or deflectors, etc., which form essential elements of many known ignition systems for post-mix burners. This is advantageous from several standpoints such as the reduced cost and maintenance of the system of this invention and reduced space requirements which may be very important in certain specific applications.

One such specific application wherein space requirements are a significant consideration is the ignition of the burner which is described and claimed in U.S. Ser. No. 138,759, filed Apr. 10, 1980, in the name of John E. Anderson, entitled "Oxygen Aspirator Burner And Process For Firing A Furnace". The direct ignition apparatus and process of this invention are particularly well suited for use in conjunction with such a burner.

The passages of the ignition system of this invention are preferably tubes and may have any convenient cross-sectional geometry. They may be circular in cross-section, or semi-circular, rectangular, etc. A preferred cross-sectional shape for the passages is a circle, i.e., the passages are preferably cylinders.

As previously mentioned, the passages are conductive to electricity. It is not critical from what material the passage is constructed as long as the material is conductive to electricity. A preferred such material is iron when the oxidant gas is air; the preferred material is copper when the oxidant gas contains higher concentrations of oxygen.

By a fuel gas, it is meant any gas which will burn such as natural gas, methane, coke oven gas, producer gas, and the like.

A preferred fuel gas is natural gas or methane.

By an oxidant gas, it is meant air, oxygen-enriched air, or pure oxygen.

A preferred oxidant gas will depend on the particular use to which the burner is put.

The passages are electrically insulated from each other. As is well known to those skilled in the art, there are many ways to effect such insulation. When mechanical requirements mandate a joining of the passages to form a single connected structure, there is interposed between them electrically insulating material. Any effective insulating material is adequate; a preferred such insulating material is fluorocarbon insulation.

An electrical potential is applied across the passages. The electrical potential is applied from any convenient source such as the secondary windings of a conventional high voltage (typically from 5000 to 9000 volts) transformer connected to a 120 volt alternating current power source.

It is important that the breakdown voltage between the passages be at a minimum at the discharge end. There are many ways of achieving this. For example, one may have passages which are parallel to one another, i.e., equi-distant at all points along their length. At the discharge end one may cut two slits in the wall of one passage so as to define a tab and then one can bend the tab toward the wall of the other passage such that the distance between the passages is smallest at the discharge end. Another way of achieving the same result is to weld a small tab to one passage at the discharge end. Of course, both slit tab and welded tab could be placed on either passage wall or on both passages so as to shorten the distance between the passages at the discharge end. Still another way to effect the desired result, i.e., breakdown voltage between the passages a minimum at the discharge end, is to place insulating material at all points between the passages except at the discharge end. Those skilled in the art may probably devise several other ways of achieving this important aspect of this invention.

The exact configuration of the passages can vary considerably and can take many forms. For illustrative purposes two such configurations will be discussed below.

In one configuration one passage is a cylindrical tube and the other passage is a cylinder which surrounds the tube along its length; thus, this configuration is two concentric cylinders. The passages are spaced apart as required by the claims. Either fuel gas or oxidant gas flows through the center tube while the other gas flows through the space between the center cylinder and the outer cylinder.

In another configuration, one passage is a cylindrical tube and the other passage is also a cylinder running side by side to the tube and spaced from the tube as required by the claims. Either fuel gas or oxidant gas flows through the tube while the other gas flows through the space between the tube and the other cylinder.

Figure 2:
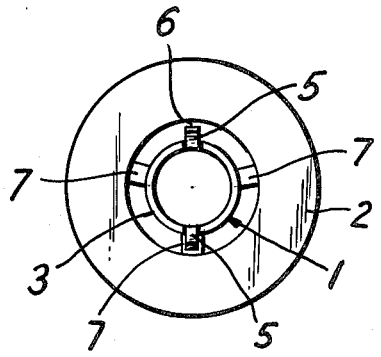
FIG. 2 is a view of the FIG. 1 embodiment, sighting from the combustion zone showing tabs used to effect the relationship between the first passage and the second passage such that the lowest breakdown voltage between the passages occurs at the discharge end.

A description of one embodiment of the ignition system of this invention is provided with reference to FIGS. 1 and 2. FIG. 1 is a lengthwise cross-section of this embodiment. FIG. 2 is a view of the FIG. 1 embodiment sighting from the combustion zone.

The passages 1 and 2 are each cylinders and arranged such that the one passage surrounds the other passage to effect a concentric cylinder arrangement. The distance between the outer passage and the wall 3 of the inner passage is substantially the same at all points along their length except at the discharge end 4 where this distance is shortened by tab 5. The distance between the tab and the surface of the outer cylinder may thus be termed the spark gap 6. The passages are at all points physically apart from one another except where mechanical connections are necessary. At these locations there is interposed fluorocarbon insulation 7 between their conductive surfaces.

Oxygen 8 is provided in the space between the outer cylinder and the inner cylinder and natural gas 9 is provided to the inside of the inner cylinder. Both of these gases flow toward the discharge end 4 and are at all points along the tube separated by tube-wall 3. As the gas streams flow past the discharge end 4, they mix generally in area 10 to form a combustible mixture. This area 10 may be termed the combustion zone.

An electrical potential is applied across the passages by means of the electrical circuit illustrated in schematic form. Transformer 15 is connected at 11 and 12 to a 110 volt alternating current 60 Hertz power supply such as normally supplies electricity to a household. Transformer 15 is a conventional step-up transformer. The high voltage outputs 13 and 14 of the transformer are connected to the inner passage and the outer passage respectively. When the voltage applied across the passages exceeds the breakdown voltage across the spark gap, the electricity discharges between the passages at this point, i.e., the discharge end, and, in so doing, ignites the combustible mixture in the combustion zone. This ignition is accomplished even though the spark traveled across an area which was filled essentially only with oxygen and did not contain a significant amount of a combustible mixture.

Figure 3:
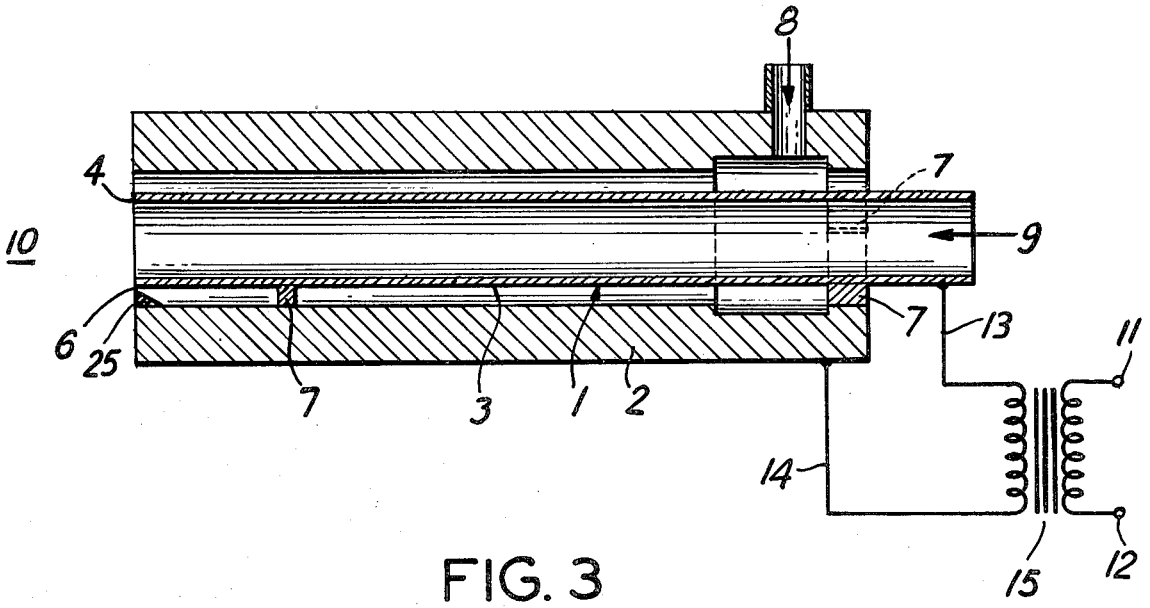
FIG. 3 is a lengthwise cross-sectional representation of another embodiment of the ignition system of this invention.
Figure 4:
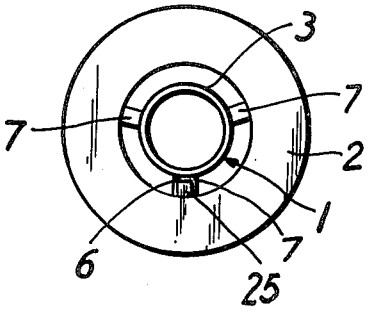
FIG. 4 is a view of the FIG. 3 embodiment sighting from the combustion zone showing solid weld tabs used to effect the relationship between the first passage and the second passage such that the lowest breakdown voltage between the passages occurs at the discharge end.

Another embodiment of the ignition system of this invention is described with reference to FIGS. 3 and 4. FIG. 3 is a lengthwise cross-section of this embodiment. FIG. 4 is a view of the FIG. 3 embodiment sighting from the combustion zone.

The numerals used in FIGS. 3 and 4 correspond to those used in FIGS. 1 and 2 with the exception that the cut tabs of FIGS. 1 and 2 are not shown. Instead, a welded tab 25 is illustrated. The tab is welded onto the outer cylinder in this illustration. In this manner, the breakdown voltage between the passages is minimized at the discharge end.

Figure 5:
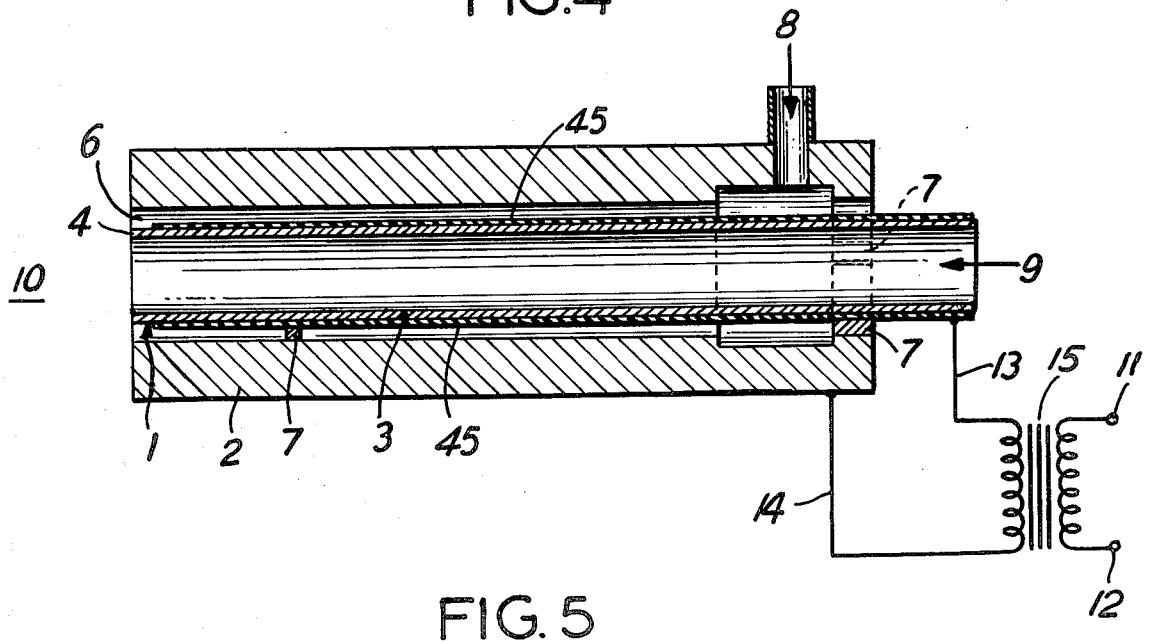
FIG. 5 is a lengthwise cross-sectional representation of another embodiment of the ignition system of this invention wherein an insulating material is employed to effect the relationship between the first passage and the second passage such that the lowest breakdown voltage between the passages occurs at the discharge end.

Still another embodiment of the ignition system of this invention is described with reference to FIG. 5, which is a lengthwise cross-section of this embodiment. The numerals used in FIG. 5 correspond to those used in the previous Figures except that neither cut tabs nor welded tabs are illustrated. Instead, there is illustrated electrical insulation 45 which runs between the passages for substantially their entire length except at the discharge end. In this manner, the breakdown voltage between the passages is minimized at the discharge end.

The following examples serve to further illustrate the beneficial results obtainable by use of the ignition system of this invention. In these examples, the ignition system employed was similar to that illustrated in FIG. 1.

The center tube had an outer diameter of 1.05 inches (2.67 cm) and the outer tube had an inner diameter of 1.38 inches (3.51 cm). Thus, the distance between the passages at all points along their length except at the discharge end was at least 0.165 inch (0.42 cm). Two tabs were cut in the center tube at the discharge end and both were bent outward toward the surface of the outer tube such that the shortest distance from the passages at the discharge end, i.e., the spark gap, was 0.063 inch (0.16 cm).

A conventional high voltage transformer with primary side ratings of 60 Hertz 120 volt alternating current and 150 volt-amp and second voltage of 6000 volt was employed to apply an electrical potential, greater than the breakdown voltage at the aforementioned shortest distance at the discharge end across the passages, and thus to cause electricity to discharge across the spark gap.

Four examples were carried out. In Example 1, the gas in the center tube was natural gas having a gross heating value of about 1000 BTU/SCH (8600 KCAL/NM$^3$) as fuel and the gas in the space between the center tube and outer tube was substantially pure oxygen as oxidant. In Example 2, the positions of the fuel and oxidant were reversed from those of Example 1. In Example 3, the gas in the center tube was natural gas as fuel and the gas in the space between the center tube and outer tube was air as oxidant. In Example 4, the positions of the fuel and oxidant were reversed from those of Example 3.

Each example was performed at several flow rates for the fuel and oxidant and the success or failure of ignition of the combustible mixture was noted. The results are shown in Tables I–IV corresponding to Examples 1–4. In the tables, the flow rates are given in two measures, standard cubic feet per hour (SCFH) and normal cubic meters per hour (NM$^3$/HR).

TABLE I

| (Example 1) | | | | |
|---|---|---|---|---|
| Fuel Flow Rate | | Oxidant Flow Rate | | |
| (SCFH), | (NM$^3$/HR) | (SCFH), | (NM$^3$/HR) | Ignition |
| 400, | 11.7 | 340, | 10 | Yes |
| 400, | 11.7 | 800, | 23.4 | Yes |
| 400, | 11.7 | 1650, | 48.3 | Yes |
| 1000, | 29.3 | 2000, | 58.6 | Yes |
| 4300, | 126.0 | 800, | 23.4 | Yes |
| 8000, | 234 | 1600, | 46.9 | Yes |

TABLE II

| (Example 2) | | | | |
|---|---|---|---|---|
| Fuel Flow Rate | | Oxidant Flow Rate | | |
| (SCFH), | (NM$^3$/HR) | (SCFH), | (NM$^3$/HR) | Ignition |
| 340, | 10 | 400, | 11.7 | Yes |
| 800, | 23.4 | 400, | 11.7 | Yes |
| 1650, | 48.3 | 400, | 11.7 | Yes |
| 1600, | 46.9 | 800, | 23.4 | Yes |
| 1600, | 46.9 | 8000, | 234 | Yes |

Tables III and IV include a column labeled Blow-off rate. This term is used to mean the rate of air flow at the particular fuel flow rate wherein the air flow extinguishes the flame because the velocity exceeds the flame velocity.

TABLE III

| (Example 3) | | | | | | |
|---|---|---|---|---|---|---|
| Fuel (Flow Rate) | | Blow-off Rate | | Oxidant (Flow Rate) | | |
| (SCFH), | (NM$^3$/HR) | (SCFH), | (NM$^3$/HR) | (SCFH), | (NM$^3$/HR) | Ignition |
| 200, | 5.9 | 540, | 15.8 | 96, | 2.8 | Yes |
| 200, | 5.9 | 540, | 15.8 | 480, | 14.1 | Yes |
| 200, | 5.9 | 540, | 15.8 | 540, | 15.8 | Yes |
| 400, | 11.7 | 870, | 25.5 | 96, | 2.8 | Yes |
| 400, | 11.7 | 870, | 25.5 | 870, | 25.5 | Yes |
| 600, | 17.6 | 1270, | 37.2 | 96, | 2.8 | Yes |
| 600, | 17.6 | 1270, | 37.2 | 870, | 25.5 | Yes |
| 600, | 17.6 | 1270, | 37.2 | 1070, | 31.4 | No |
| 800, | 23.4 | 1470, | 43.1 | 870, | 25.5 | Yes |
| 800, | 23.4 | 1470, | 43.1 | 1070, | 31.4 | No |
| 800, | 23.4 | 1470, | 43.1 | 1270, | 37.2 | No |
| 800, | 23.4 | 1470, | 43.1 | 1470, | 43.1 | No |
| 1000, | 29.3 | 1570, | 46.0 | 870, | 25.5 | Yes |
| 1000, | 29.3 | 1570, | 46.0 | 1070, | 31.4 | No |
| 1000, | 29.3 | 1570, | 4610 | 1370, | 40.1 | No |
| 1000, | 29.3 | 1570, | 4610 | 1570, | 46.1 | No |

TABLE IV

| (Example 4) | | | | | | |
|---|---|---|---|---|---|---|
| Fuel (Flow Rate) | | Blow-off Rate | | Oxidant (Flow Rate) | | |
| (SCFH), | (NM$^3$/HR) | (SCFH), | (NM$^3$/HR) | (SCFH), | (NM$^3$/HR) | Ignition |
| 200, | 5.9 | 1690, | 49.5 | 870, | 25.5 | Yes |
| 200, | 5.9 | 1690, | 49.5 | 1070, | 31.4 | Yes |
| 200, | 5.9 | 1690, | 49.5 | 1270, | 37.2 | No |
| 400, | 11.7 | 1900, | 55.7 | 870, | 25.5 | Yes |
| 400, | 11.7 | 1900, | 55.7 | 1900, | 55.7 | Yes |
| 600, | 17.6 | 2360, | 69.1 | 1270, | 37.2 | Yes |
| 600, | 17.6 | 2360, | 69.1 | 1470, | 43.1 | No |
| 800, | 23.4 | 1810, | 53.0 | 1070, | 31.4 | Yes |
| 800, | 23.4 | 1810, | 53.0 | 1270, | 37.2 | No |
| 800, | 23.4 | 1810, | 53.0 | 1810, | 53.0 | No |
| 1000, | 29.3 | 2020, | 59.2 | 870, | 25.5 | No |
| 1000, | 29.3 | 2020, | 59.2 | 1070, | 31.4 | No |
| 1000, | 29.3 | 2020, | 59.2 | 1270, | 37.2 | No |
| 1000, | 29.3 | 2020, | 59.2 | 1810, | 53.0 | No |

As is demonstrated in the examples, the apparatus and process of this invention provides reliable ignition for post-mixed burners at low levels of energy consumption, without the need for substantial modifications to the burner assembly, and without the need to provide spark to an area of good fuel-oxidant mixing. Applicants believe that the lack of ignition at some of the high fuel flow rates when air was employed as the oxidant may be because the energy of the spark available to initiate ignition becomes rapidly dissipated. In such a situation, ignition can be achieved by igniting the burner at a lower flow rate and increasing the flow rate while burning continues. This procedure is the one often used in industrial applications to fire a burner at high rates, irrespective of the ignition system employed, since one wishes to avoid the large and dangerous presence of fuel in the combustion chamber if ignition does not occur.

Heretofore it has been assumed that reliable ignition of a fuel-oxidant mixture requires that the ignition source, i.e., spark, be provided at a point characterized by good mixing of fuel and oxidant. As can be appreciated from the description, the ignition system of this invention provides spark to an area where there is not good mixing of fuel and oxidant. Yet there is observed reliable ignition. This reliability was not expected.

While applicants have described the ignition system of this invention in detail with reference to several embodiments, it can be appreciated that there are many other embodiments of this invention which are within the scope and spirit of the claimed invention.

What is claimed is:

1. A post-mixed burner apparatus capable of igniting a combustible gas mixture of fuel and oxidant discharged from the burner comprising:

a first passage means for supplying fuel gas and a second passage means for supplying oxidant gas, both of said passage means terminating at the discharge end of said apparatus, characterized by an ignition system consisting of:

(1) said first passage means being electrically conductive;

(2) said second passage means being electrically conductive and means spacing said second passage means from said first passage means such that the breakdown voltage between said first and second passage means is lowest at the discharge end of said apparatus; and (3) means for applying an electrical potential across said first and second passage means, whereby, when an electrical potential greater than said lowest breakdown voltage is applied across said first and second passage means, an electrical discharge occurs, in an essentially straight line, only across the space between said first and second passage means at the discharge end.

2. The apparatus of claim 1 wherein said first and second passage means are tubes.

3. The apparatus of claim 2 wherein said first passage means is a cylindrical tube.

4. The apparatus of claim 2 wherein said second passage means is a cylindrical tube.

5. The apparatus of claim 2 wherein both first and second passage means are cylindrical tubes.

6. The apparatus of claim 5 wherein said first and second passage means are parallel along their length.

7. The apparatus of claim 6 wherein said first and second passage means are concentric cylindrical tubes.

8. The apparatus of claim 1 wherein said spacing means comprises an electrically conductive tab connected to at least one passage means at the discharge end so as to minimize the breakdown voltage between the first and second passage means at the discharge end.

9. The apparatus of claim 1 wherein said spacing means comprises electrical insulation between said first and second passage means except at the discharge end so as to minimize the breakdown voltage between the first and second passage means at the discharge end.

10. A process for igniting a combustible gaseous mixture discharged from a burner comprising:

(A) causing a stream of fuel gas and a stream of oxidant gas to flow in the same direction through first and second passages which are electrically conductive, insulated from each other and terminate at the discharge end of the burner;

(B) maintaining said flowing streams separated from each other by said first passage;

(C) mixing said gas streams upon discharge from said passages at the discharge end of the burner;

(D) spacing said second passage from said first passage such that the breakdown voltage between said first and second passages is lowest at the discharge end of the burner; and (E) applying an electrical potential greater than said lowest breakdown voltage across said first and second passages such that an electrical discharge occurs, in an essentially straight line, only across the space between said first and second passage at the discharge end of the burner, which space contains essentially only one of the gases.

11. The process of claim 10 wherein fuel gas flows through the first passage means and oxidant gas flows through the second passage means.

12. The process of claim 10 wherein fuel gas flows through the second passage means and oxidant gas flows through the first passage means.

13. The process of claim 10 wherein said fuel gas is natural gas.

14. The process of claim 10 wherein said oxidant gas is substantially pure oxygen.

15. The process of claim 10 wherein said oxidant gas is air.

* * * * *

UNITED STATES PATENT AND TRADEMARK OFFICE

CERTIFICATE OF CORRECTION

PATENT NO. : 4,431,400

DATED : February 14, 1984

INVENTOR(S) : H. Kobayashi et al

It is certified that error appears in the above-identified patent and that said Letters Patent is hereby corrected as shown below:

Column 8, in Table III, in the 4th column from the left headed ($NM^3/HR$), in both the fifteenth and sixteenth lines of this column, delete "4610" and substitute therefore --46.0--.

Signed and Sealed this

*First* Day of *May 1984*

[SEAL]

*Attest:*

GERALD J. MOSSINGHOFF

*Attesting Officer*

*Commissioner of Patents and Trademarks*